United States Patent [19]

Noffsinger

[11] Patent Number: 4,875,302

[45] Date of Patent: Oct. 24, 1989

[54] COLLAPSIBLE DISPLAY SIGN

[76] Inventor: Alfred A. Noffsinger, 73-271 Haystack Rd., Palm Desert, Calif. 92260

[21] Appl. No.: 178,597

[22] Filed: Apr. 7, 1988

[51] Int. Cl.[4] ..... G09F 15/10

[52] U.S. Cl. ..... 40/610; 40/606; 40/603; 248/472; 248/150

[58] Field of Search ..... 40/584, 603, 610

[56] References Cited

U.S. PATENT DOCUMENTS

| | | | |
|---|---|---|---|
| 2,746,703 | 5/1956 | Emery | 248/150 |
| 2,756,526 | 7/1956 | Stein et al. | 40/610 |
| 2,869,504 | 1/1959 | Andrews et al. | 40/610 |
| 3,007,269 | 11/1961 | Jump | 40/610 |
| 3,013,757 | 12/1961 | Brammer | 248/150 |
| 3,165,847 | 1/1965 | Gunderson | 248/472 |
| 3,798,814 | 3/1974 | Harmon | 40/606 |
| 4,171,585 | 10/1979 | Macuka | 40/603 |

*Primary Examiner*—Gene Mancene
*Assistant Examiner*—Wenceslao J. Contreras
*Attorney, Agent, or Firm*—Francis X. LoJacono

[57] ABSTRACT

The present invention provides a collapsible sign apparatus that is readily portable and usable for temporary applications, wherein the apparatus is formed with a pair of hinged leg-support frame members which are adjustable controlled from a folded mode to a fully extended mode by means of a slidable frame member having guide members that movably engage the hinged leg-support frames. A stretchable elastic fabric is secured at its opposite ends to each respective leg-support frame member, the intermediate portion of the fabric being mounted for engagement with the slidable perpendicular frame member, whereby the elastic stretching of the fabric will bias the support frame members to a sustantially secure open position by placing an outward and upward force on the respective leg-support frame members. When in a folded position, the fabric is forced upwardly, thus preventing the leg-support frame members from moving to an open position, unless forced to do so against the fabric's spring-like tension.

13 Claims, 2 Drawing Sheets

FIG. 1
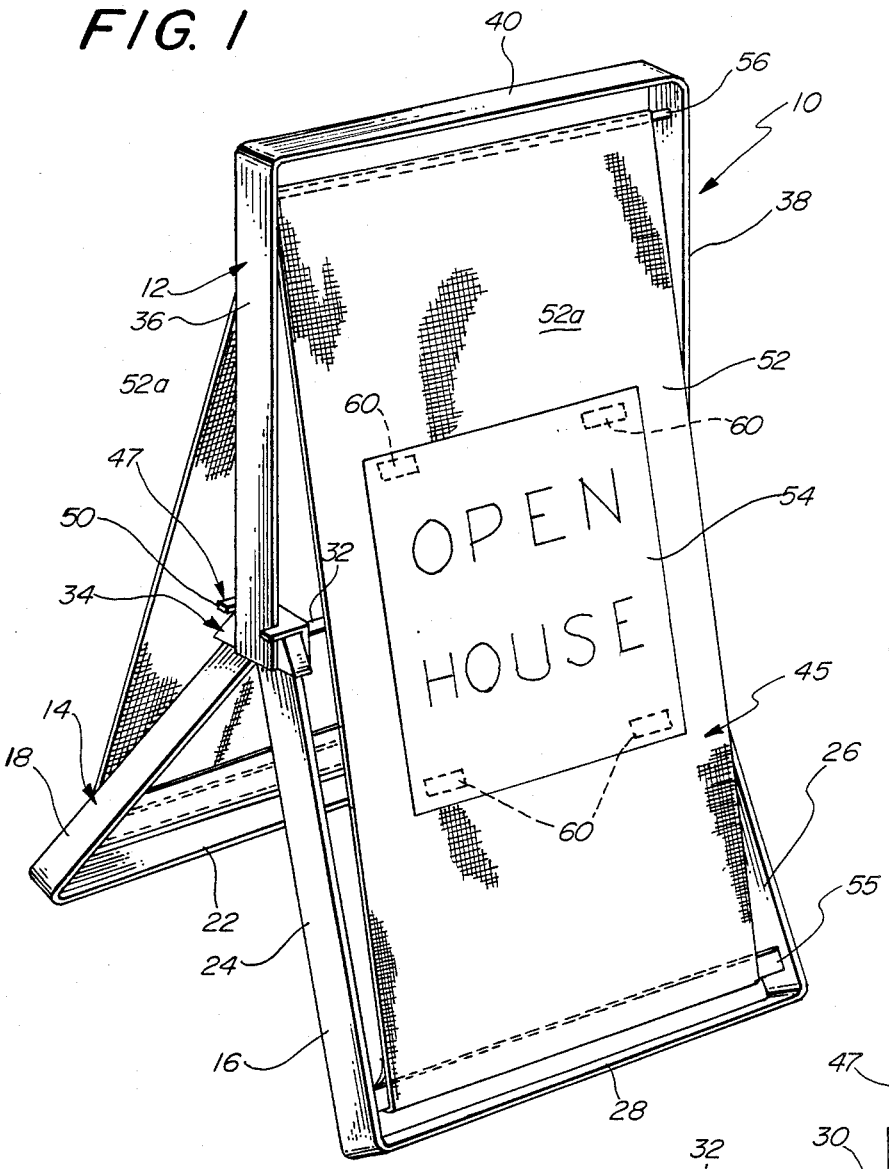
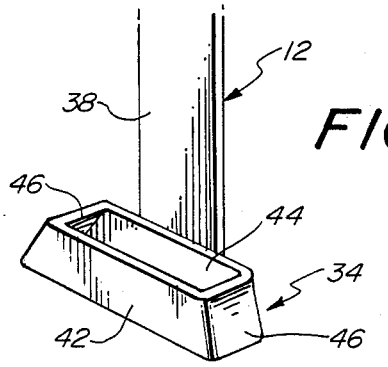
FIG. 5
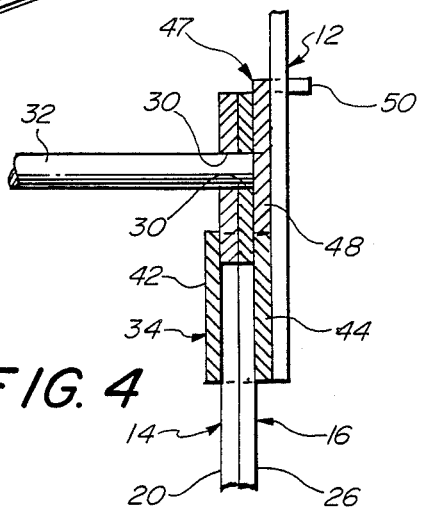
FIG. 4

COLLAPSIBLE DISPLAY SIGN

BACKGROUND OF THE INVENTION

The present invention relates to display signs and more particularly to a transportable display sign formed as a lightweight collapsible apparatus intended for temporary use.

Many known temporary display-signs have been and are presently being employed in a very limited way due to their intrinsic design flaws and cumbersome structures. Further, most of these known portable display sign devices incorporate features that restrict their applications to particular situations or circumstances which are not related to those of the present invention.

Some foldable sign devices include those that are formed with two face members hinged together at their upper ends with the face members being spread apart when in use. These types of devices are often found as road signs or road barriers for directing or rerouting the flow of traffic. Such structures include flashing light fixtures. There are many variations of the simple sign structure; however, due to their heavy construction, they are often not compatible in other operations or businesses, such as temporary signs used in real estate advertising by sales personnel.

Thus, various problems and difficulties are being encountered in providing a suitable temporary sign device that can be employed in those areas where fixed signs are prohibited due to city or local ordinances.

SUMMARY AND OBJECTS OF THE INVENTION

The present invention has for an important object to provide a display-sign device that overcomes the many problems now encountered with the known temporary sign structures mentioned above.

It is another object of the present invention to provide a simple foldable, lightweight, sign apparatus that is formed with a pair of hinged leg members and a slidable upper frame member that is arranged to allow the leg members to be positioned in either a fully folded mode or in a fully open display mode. To aid in the positioning of the leg members in both a closed and an open mode, there is provided a stretchable elastic-type material. The ends of the material are secured adjacent the lower ends of the leg members, and the intermediate portion of the material is supported by the upper portion of the vertical slidable frame member. When the legs are folded closed, there is enough tension placed on the leg members, by means of the stretchable material, to prevent the legs from spreading outwardly. Accordingly, when the legs are hinged outwardly in a fully open mode, the material is stretched so as to be very taught, thus preventing the legs from folding inwardly until inward force is applied to the leg members to overcome the outward biasing action of the stretched material.

Still another object of the present invention is to provide a collapsible sign of this type wherein the stretchable material is also employed as the face of the sign, whereby indicia or lettering may be directly printed thereon, or separate sign members may be removably mounted to the side faces of the material.

Is is still another object of the present invention to provide a device of this character that is easy and simple to employ, and is constructed so as to be very lightweight so as to be easily carried from one place to another for use.

It is a further object of the invention to provide a sign device of this character that is constructed with relatively few operating parts, and is relatively inexpensive to manufacture.

Still another object of the invention is to provide a device of this character that is easy to service and maintain, and allows one to interchange sign displays as the situation requires.

The various features of novelty which characterize the invention are pointed out with particularity in the claims annexed to and forming a part of this disclosure. For a better understanding of the invention, its operating advantages by its use, reference should be had to the accompanying drawings and descriptive matter in which there is illustrated and described the preferred embodiment of the invention.

BRIEF DESCRIPTION OF THE DRAWINGS

Referring more particularly to the accompanying drawings, which are for illustrative purposes only and wherein like numbers refer to like parts:

FIG. 1 is a perspective view of a foldable sign display in a fully open mode having a sign mounted thereon;

FIG. 4 is an enlarged cross-sectional view taken along line 4—4 of FIG. 2; and FIG. 5 is a perspective view of the leg control means used to control the movement and positioning of the leg frame members.

DESCRIPTION OF THE PREFERRED EMBODIMENT

Figure 2:
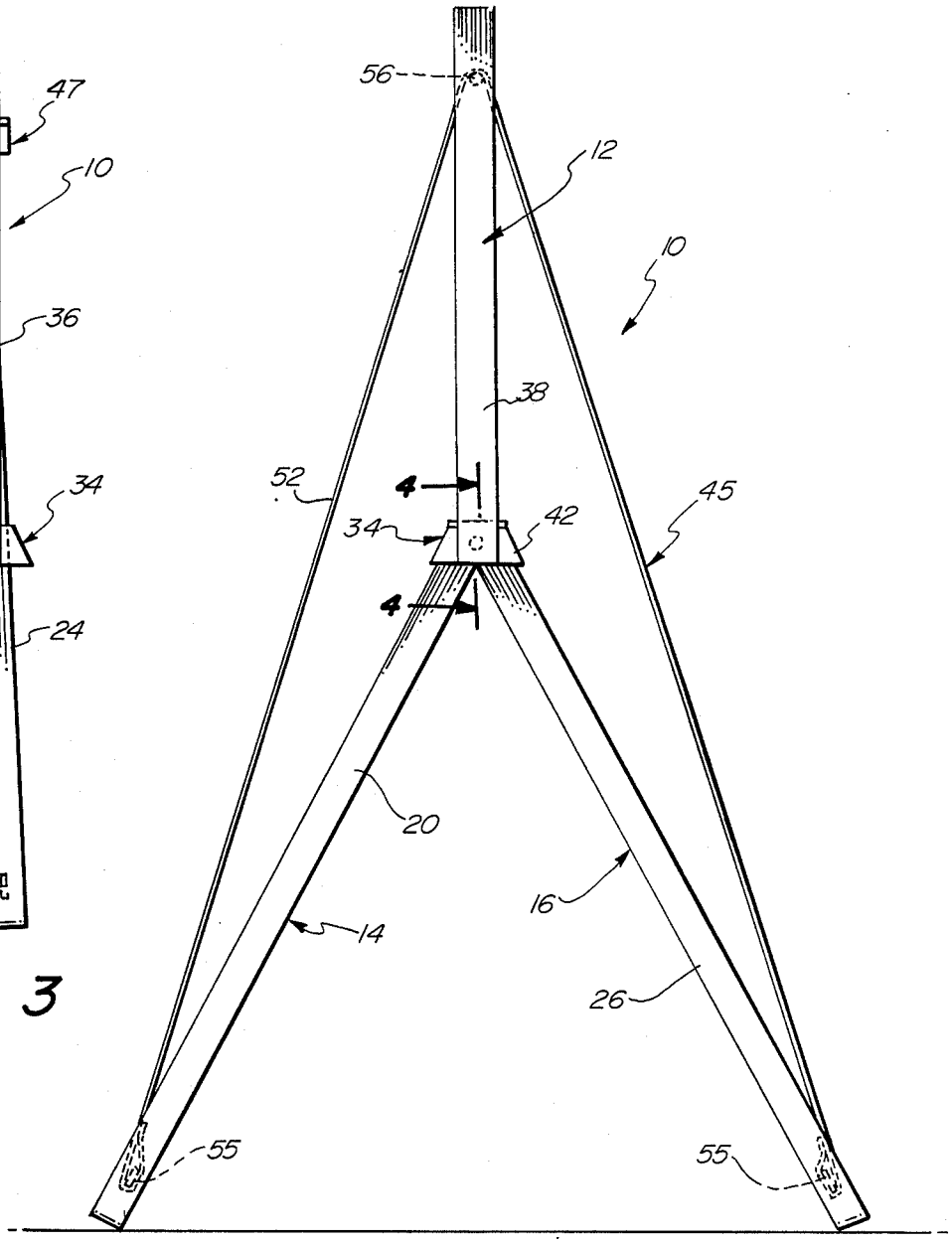
FIG. 2 is a side-elevational view of the opposite side thereof not seen in FIG. 1.

Referring more particularly to FIGS. 1 and 2, there is shown a collapsible display sign, generally indicated at 10, which is illustrated in both figures as being positioned in a fully open mode or stance. The display sign 10 comprises a three-part frame structure and a biasing means to control the positioning of the frame members between a closed or collapsible mode, as seen in FIG. 1, to a fully open mode, as indicated in FIGS. 1 and 2.

Accordingly, there is a sliding frame member, generally indicated at 12, which is adapted to be moved up and down for opening and closing the display sign. Frame member 12 slidably moves substantially in a vertical position relative to a pair of hinged support frame members, indicated generally at 14 and 16 respectively, which are pivotally mounted to each other at their upper free ends. The first support frame member 14 comprises a pair of substantially upright leg members 18 and 20 which are integrally interconnected at their lower ends by a strut member 22, thus defining a substantially "U" shaped framework. The second support frame member 16 is also formed with a substantially "U" shaped configuration comprising a pair of oppositely disposed, parallel leg members 24 and 26 integrally interconnected by strut member 28. However, it is important to note that various strut arrangements may be used in order to secure the leg members in a fixed parallel relation to each other.

In order to establish a hinged means between the respective support frame members 14 and 16, each upper free end of each leg member 18, 20, 24 and 26 is provided with a hole 30, as shown in FIG. 4. These oppositely positioned holes 30 are aligned to receive a shaft 32 which extends across the open end of support frames 14 and 16.

Before shaft 32 is mounted in its horizontal position, sliding frame 12 is slidably mounted over the respective leg members 18, 24 and 20, 26 by means of a leg-positioning means, designated by numeral 34 and better shown in FIG. 5, the positioning means being affixed to each free end of sliding frame 12 by a suitable means such as welding.

Figure 3:
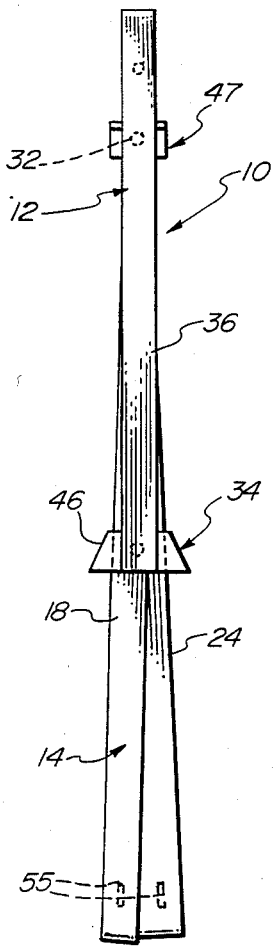
FIG. 3 is a side-elevational view of the present invention shown in a folded mode for carrying or for storing.

Sliding frame 12 comprises a pair of depending arm members 36 and 38 which are arranged parallel to each other. Frame 12 is shown as a one-piece, inverted "U" shaped member having an integrally formed strut member 40 which also provides a handle means. Accordingly, leg-positioning means 34 is mounted adjacent the free ends of each arm member 36 and 38, and is formed as a tapered sleeve having perpendicular front and rear walls 42 and 44, and inclined side walls 46. When sliding frame 12 is in an upward position, the support frame members 14 and 16 are allowed to be moved to an open position by the biasing means, generally indicated at 45. To close or fold support frame members 14 and 16, sliding frame 12 is forced downwardly, thus bringing the pivotally mounted support frame members inwardly, as shown in FIG. 3.

To aid in the vertical sliding movement of frame member 12, there is provided a guide means 47 which is secured to the ends of shaft 32, as illustrated in FIG. 4. The guide means is formed with a face plate 48 which has laterally extending ear members 50 arranged to be positioned in the opposite edges of arm members 36 and 38.

In order to provide the necessary biasing means 45, there is employed a material or fabric 52 which has elastic characteristics. This fabric is used herein as a means to prevent the support legs from unfolding when in a collapsed mode, as seen in FIG. 3, and when in an extended open position the stretchable material becomes very taught and firm, as seen in FIG. 2. It should also be noted that the cloth-like fabric can also be imprinted for use as a sign board or other removable signs can be mounted thereto, as indicated by sign 54. This fabric consists of 91% nylon and 9% spandex.

As illustrated in FIGS. 1 and 2, each end of the fabric is secured to a cross bar 55 mounted between parallel leg members 18 and 20, and 24 and 26, respectively. After being secured at one cross bar 55, fabric 52 is mounted over a pull-bar member 56 interposed between arms 36 and 38 of slidable frame 12, and adjacent the upper end thereof. Thus, in a collapsed or folded mode, fabric is slightly stretched to provide an upward pull on frames 14 and 16—not only securing them in the folded mode of FIG. 2, but allowing the display sign 10 to be carried by strut member 40 without causing the support frame member to open. In order to open or spread support frames 14 and 16, one only has to place a foot on one strut member 22 or 28 and pull handle member 40 in an upward direction. Leg-positioning means 34 will rise with sliding frame 12, thus allowing the two leg frame members 14 and 16 to spread apart. At the same time, fabric 52 is firmly stretched, thereby establishing a pair of oppositely positioned sign faces 52*a*. Indicia can be readily applied to these surfaces, such as by silk screening, if desired. A removable sign member 54, including attaching means 60, may also be used. The apparatus is readily foldable by forcing frame 12 downwardly, with one support frame raised off the ground. Positioning means 34 will force the two support frame members to pivot inwardly to a closed position, as seen in FIG. 3.

The foregoing is a description of a preferred embodiment of the invention which is given here by way of example only. The invention is not to be taken as limited to any of the specific features as described, but comprehends all such variations thereof as come within the scope of the appended claims.

I claim:

1. A portable and foldable sign apparatus, comprising:

a first support frame member;

a second support frame member;

said first and second support frame members being hinged together so as to be positioned between a closed folded position and an open extended position;

a slidable frame member slidably engaged with said first and second support frame members, whereby the positioning of said slidable frame member controls the positioning of said first and second support frame members;

biasing means attached to said first and second support frame members engageable with said slidable frame member, whereby said support frame members are held in a relatively fixed closed or open position with respect to said slidable frame member.

2. A portable and foldable sign apparatus as recited in claim 1, wherein said slidable frame member includes a leg-positioning means whereby the closed and open positions of said support members are controlled by the location of said leg-positioning means which directly engages said support frame members so as to limit the opening stance between said support frame members.

3. A portable and foldable sign apparatus as recited in claim 2, wherein each of said first and second support frame members includes:

a hinge means; and a guide means attached to said hinge means whereby the slidable frame member is guided in a perpendicular movement with respect to said hinged support frame members.

4. An apparatus as recited in claim 3, wherein said biasing means comprises an elongated sheet of elastic fabric having each end thereof attached adjacent the lower end of said corresponding support frame member, and wherein said elastic fabric is supported by said slidable framework intermediate said ends of said elastic fabric, whereby a biasing force is applied to said support frame members when positioned in either an open or closed mode.

5. An apparatus as recited in claim 1, wherein said biasing means comprises an elongated sheet of elastic fabric having each end thereof attached adjacent the lower end of said corresponding support frame member, and wherein said elastic fabric is engaged and supported by said slidable frame member, whereby a biasing force is applied to said support frame members at all times, and whereby the upward movement of said slidable frame member will cause said first and second support frame members to open to an extended position and be held therein until said slidable frame member is forced downwardly to a closed position.

6. An apparatus as recited in claim 5, wherein said slidable frame member includes a leg-positioning means, whereby the closed and open positions of said support members are controlled by the engagement of said leg-positioning means as said slidable frame member is raised and lowered with respect to said first and second support frame members; and wherein said support members include a hinge means and a guide means attached to said hinge means, whereby said slidable frame member is guided in a perpendicular sliding movement with respect to said hinged support frame members.

7. An apparatus as recited in claim 1, wherein said biasing means comprises an elongated sheet of elastic fabric having each end thereof attached to said corresponding support frame member adjacent the lower end thereof, the intermediate portion of said elastic fabric being supported by said slidable frame members.

8. An apparatus as recited in claim 7, wherein said sliding frame member comprises:

a pair of parallel arm members;

a strut member interconnecting said arm members; and a cross bar positioned to support the intermediate portion of said elastic fabric.

9. An apparatus as recited in claim 8, wherein said first and second support frame members comprise:

a pair of parallel leg members;

a strut member interconnecting said leg members; and a cross bar positioned between said leg members adjacent the lower end thereof whereby said respective ends of said elastic fabric are attached thereto; and means for hinging the upper ends of said leg members together.

10. An apparatus as recited in claim 7, wherein said elastic fabric defines sign surfaces wherein indicia are applied thereto.

11. An apparatus as recited in claim 7, wherein said elastic fabric defines sign surfaces wherein signs are removably attached thereto.

12. An apparatus as recited in claim 9, wherein said leg-positioning means comprises a sleeve attached to the lower end of each of said arm members and positioned to slidably receive said leg members of said support frame members.

13. An apparatus as recited in claim 12, wherein said sleeve is formed with inclined side walls positioned to engage said leg members.

* * * * *